US006505419B2

(12) United States Patent
Poetter

(10) Patent No.: US 6,505,419 B2
(45) Date of Patent: Jan. 14, 2003

(54) DRYING COMPARTMENT FOR A PRINTED WEB

(75) Inventor: Dietmar Poetter, Westerkappeln (DE)

(73) Assignee: Windmoeller & Hoelscher, Lengerich (DE)

( * ) Notice: Subject to any disclaimer, the term of this patent is extended or adjusted under 35 U.S.C. 154(b) by 0 days.

(21) Appl. No.: 09/906,088

(22) Filed: Jul. 17, 2001

(65) Prior Publication Data

US 2002/0040536 A1 Apr. 11, 2002

(30) Foreign Application Priority Data

Jul. 17, 2000 (DE) ..... 100 34 708

(51) Int. Cl.[7] ..... F26B 13/02

(52) U.S. Cl. ..... 34/632; 34/114; 34/274; 34/629; 34/633; 34/638

(58) Field of Search ..... 34/114, 122, 267, 34/273, 274, 623, 629, 632, 633, 638

(56) References Cited

U.S. PATENT DOCUMENTS

| | | | | |
|---|---|---|---|---|
| 4,767,042 A | * | 8/1988 | Daane | 242/615.1 |
| 5,967,457 A | * | 10/1999 | Wildenberg | 34/635 |
| 5,970,627 A | * | 10/1999 | Stenz | 34/633 |
| 6,176,184 B1 | * | 1/2001 | Mudry | 101/424.1 |
| 6,328,852 B1 | * | 12/2001 | McGary | 162/199 |

* cited by examiner

*Primary Examiner*—Ira S. Lazarus
*Assistant Examiner*—Kathryn S. O'Malley
(74) *Attorney, Agent, or Firm*—Jacobson & Holman PLLC

(57) ABSTRACT

A drying compartment for drying a printed web, consisting of a housing with intake and outlet openings for the web and with at least one infrared radiator directed at the web and/or with blower nozzles which blow hot air onto the web. In order to remove layers of air entrained by the web, turbulence generators are positioned above the web, or above and below the web.

18 Claims, 3 Drawing Sheets

DRYING COMPARTMENT FOR A PRINTED WEB

BACKGROUND OF THE INVENTION

1. Field of the Invention

The invention relates to a drying compartment for drying a printed web, consisting of a housing with intake and outlet openings for the web and with at least one infrared radiator directed at the web and/or with blower nozzles which blow hot air onto the web, preferably a drying compartment for webs printed in flexographic print, which compartment is positioned on the bridge between the flexographic printing machine and the devices for unrolling and rolling up the web.

2. Description of the Related Art

In order to be dried, these printed webs run through a drying compartment. Inside the drying compartment, drying is performed by I.R. radiators and/or blower nozzles which blow heated air onto the web. With the drying of printed webs in the drying compartment, however, a problem arises in that successful and rapid drying is hindered due to fact that the web entering the drying compartment through an intake opening entrains air that forms an insulating layer adhering to the web, one that hinders successful drying.

SUMMARY OF THE INVENTION

The goal of the invention, therefore, is to create a drying compartment of the initially described type, in which the insulating layer of air that covers the web is eliminated and it is no longer able to hinder and delay drying of the web.

The invention solves this problem by positioning turbulence generators in the drying compartment above the web. The web to be dried conventionally runs into the drying compartment with the printed side upward, so that the turbulence generators positioned above the web strike the web with a turbulent air current whose swirling motion dissolves and eliminates the insulating air layer or bordering layer entrained by the web, with the result that the drying devices consisting of blower nozzles and/or I.R. radiators can act on the web without hindrance from an insulating layer of air.

It is expedient to position turbulence generators on both sides of the web.

The turbulence generators can consist of curved or diagonally inclined metal sheets positioned perpendicular to the web's direction of travel and parallel to said direction. Here the diagonally inclined metal sheets will be positioned at an acute angle against the web's direction of travel, so that said sheets will, as it were, peel off the air layers covering the web.

In a preferred embodiment, curved metal sheets in the shape of cylindrical bowls are positioned on both sides of the web. These sheets will preferably be situated in such a way that the concave sides of the metal sheets face each other.

BRIEF DESCRIPTION OF THE DRAWINGS

This bilateral arrangement of the curved metal sheets forming cylindrical bowls is particularly advantageous, even though the web usually runs over rollers that guide it, to prevent metal sheets that are positioned on only one side from exerting suction on the web and raising it due to their concave profile. If the curved and ideally concave metal sheets are positioned on both sides of the web in mirror-image fashion, the suction or pressure forces exerted on the web by the metal sheets cancel each other out.

Ideally the curved metal sheets will have a contour with an airfoil shape.

Figure 1:
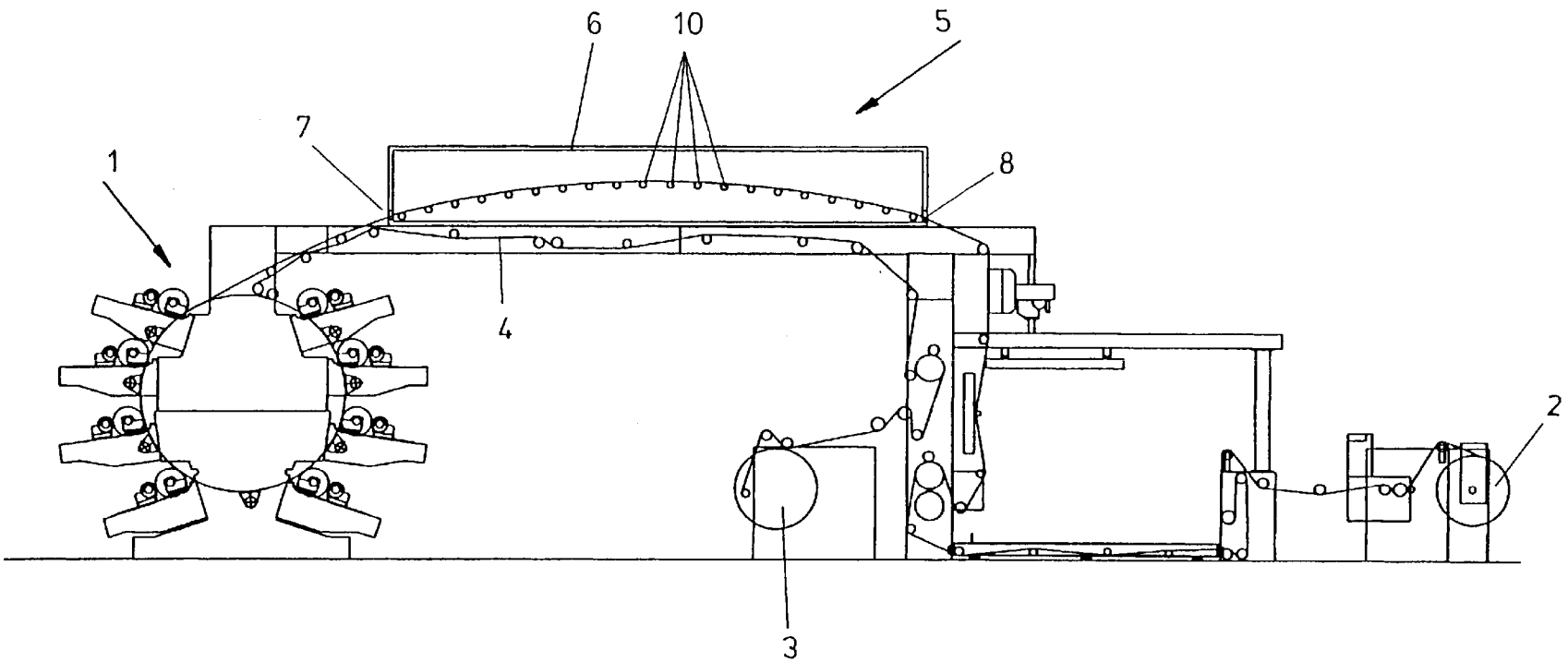
Figure 2:
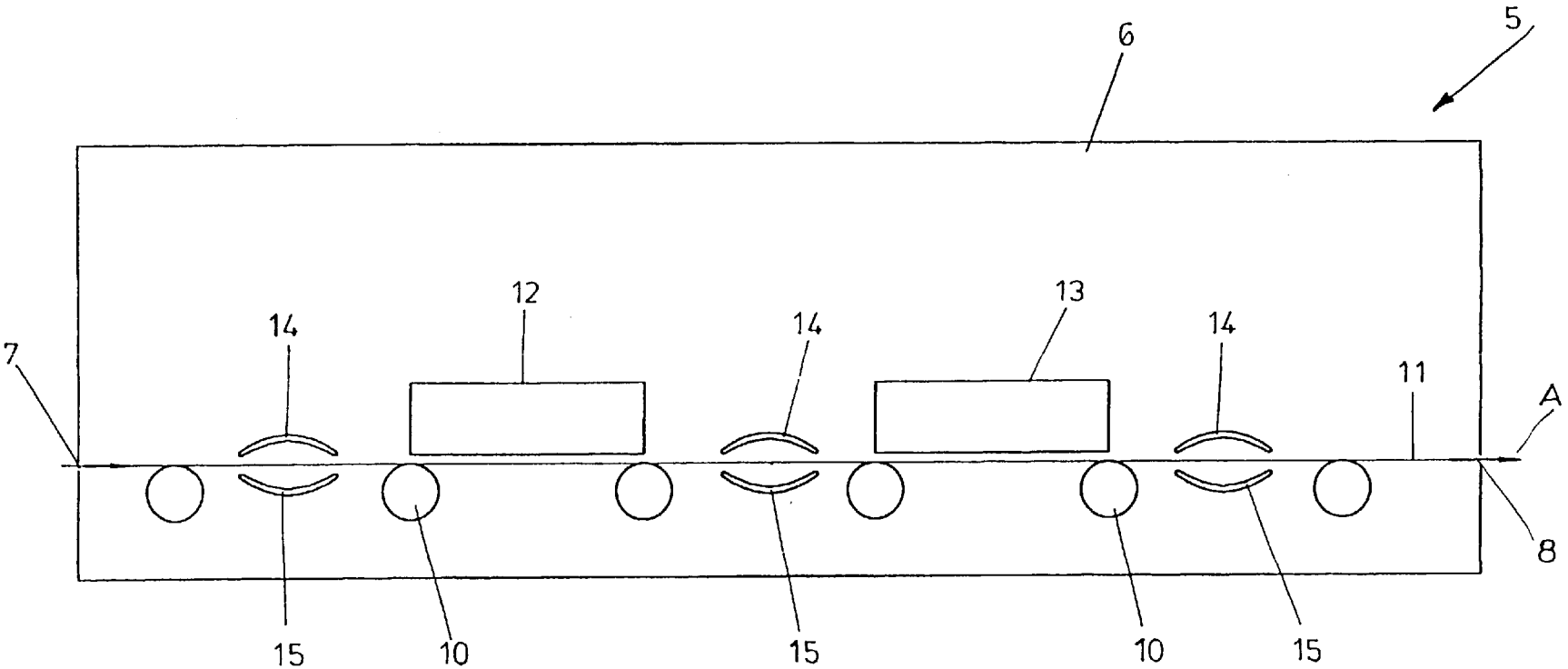
Figure 3:
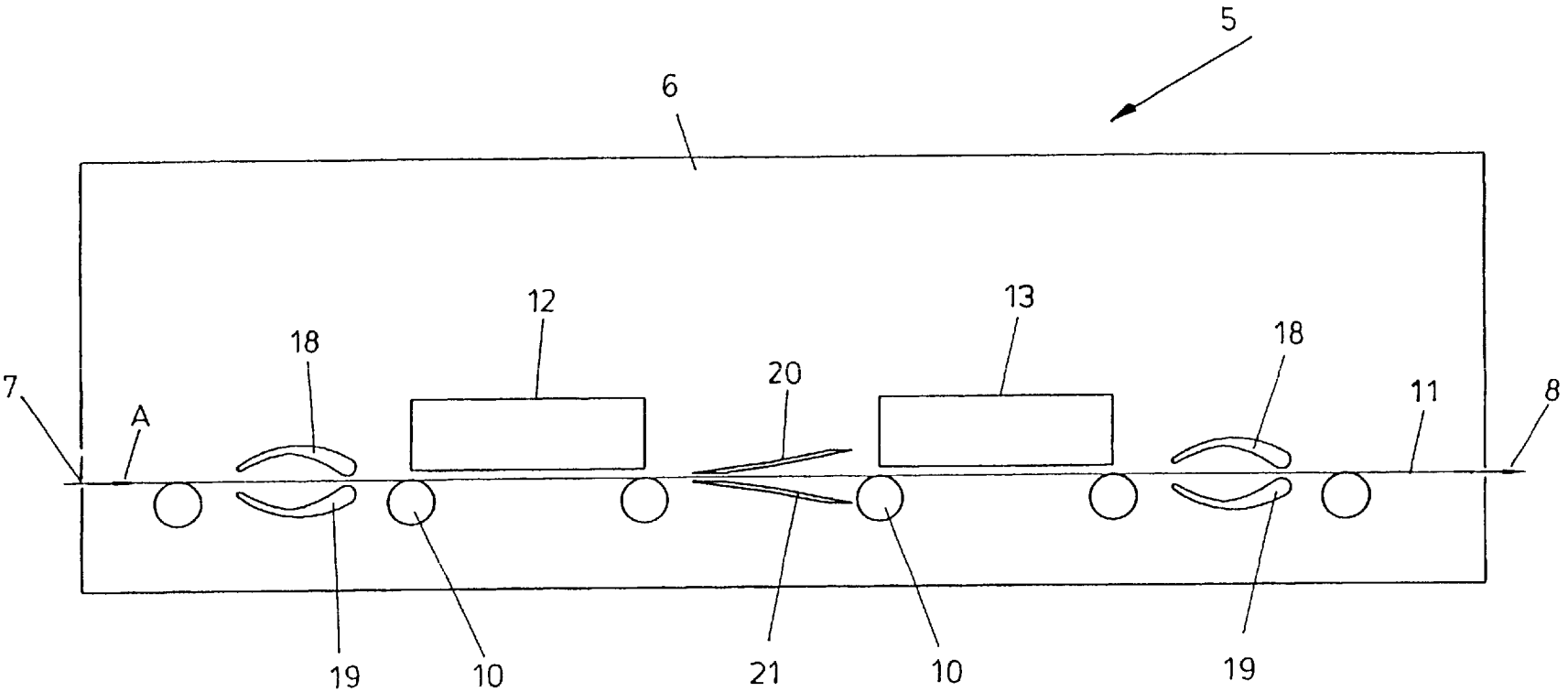

Exemplary embodiments of the invention will next be described in greater detail on the basis of the drawing. The figures in the drawing show:

FIG. 1 an eight-color flexographic printing press with unrolling and rolling-up devices for the printed webs and a bridge that connects the two devices, with a drying compartment positioned on said bridge, in a schematic side view;

FIG. 2 a schematic side view of an initial embodiment of the drying compartment with its front wall removed, in a schematic depiction;

FIG. 3 a second embodiment of the drying compartment corresponding to FIG. 2.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Visible in FIG. 1 is an eight-color flexographic printing press 1 with eight printing units, whose printing rollers are positioned on a shared counter-pressure cylinder. To unroll a web that is to be printed from a storage roll 3 and to roll up the printed web on a roll 2, conventional rolling devices are provided for unrolling and rolling up; here the web to be printed and the web that has been printed are guided over a bridge 4 which connects the unrolling and rolling-up devices with the flexographic printing press 1.

Positioned on the bridge 4 is a drying compartment 5 enclosed in a housing through which the printed web runs from the flexographic printing press 1 to the rolling-up device. The housing 6 of the drying compartment 5 is provided with an intake slot 7 and an outlet slot 8 for the printed web being dried. In the housing 6 of the drying compartment 5 guide rollers 10 will ideally be mounted on a curved track over which the printed web 11 being dried runs.

Above the web 11 being dried, drying devices are directed at the printed side; in the depicted embodiment these drying devices consist of a convector 12 and infrared radiators 13. The convector 12 can be a blower nozzle configuration which blows hot air onto the printed web 11.

Between the guide rollers 10 and on both sides of the convector 12 and the infrared radiator 13 bowl-shaped metal sheets 14, 15 are positioned above and below the web 11, whose concave sides face each other. The curved bowl-shaped sheets 14, 15 are positioned at a distance from the web such that their concave sides face each other, thereby forming gap-like intake and outlet slits. Based on their shape, the sheets 14, 15, produce a turbulent current that impinges on both sides of the web and dissolves the entrained insulating air layers. The bowl-shaped sheets 14, 15 are positioned in mirror-image fashion relative to the plane of travel of the web 11, with the result that the suction effects exerted by the sheets on the web cancel each other out due to the air currents.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The direction of travel of the web 11 through the drying compartment is indicated by the arrow A.

Visible in FIG. 3 are alternative designs for the turbulence generators; these designs can be employed alone or combination with each other. Bordering on the intake and outlet areas are bowl-shaped metal sheets or bodies 18, 19 that are curved, while the concave sides are turned to face each other. The sheets or bodies 18, 19 are positioned in mirror-image fashion relative to the plane of travel of the web 11 being dried.

Positioned in the center area of the drying compartment are diagonally inclined or slightly curved sheets 20, 21 whose knife-edged inlet edges are positioned against the direction of travel of the web 11 on both sides, so that they, so to speak, peel off the air layers adhering to the web. The metal sheets 20, 21 are also positioned in mirror-image fashion relative to the plane of travel of the web 11.

What is claimed is:

1. A drying compartment for drying a printed web upon which an insulating layer of air is entrained when said web moves at sufficient speed, said drying compartment comprising:

a housing with intake and outlet openings for the printed web;

a drying device located within said housing and directed at said web for drying thereof; and a turbulence generator mounted within said housing and at least above said web, said turbulence generator formed of metal sheets having a shape which disrupts said insulating air layer to increase an effectiveness of said drying device.

2. The drying compartment as set forth in claim 1, wherein said drying device includes at least one of an infrared radiator and a convector which blows hot air onto the web.

3. The drying compartment as set forth in claim 1, wherein said metal sheets are positioned on both sides of said web.

4. The drying compartment as set forth in claim 1, wherein said turbulence generator includes a pair of diagonally inclined metal sheets, arranged in mirror-image fashion on either side of said web, knife-edged inlet edges of said diagonally inclined sheets positioned against a direction of travel of said web, said inlet edges being closer to said web than outlet edges of said sheets.

5. The drying compartment as set forth in claim 1, wherein said turbulence generator includes a pair of curved metal sheets which are positioned perpendicular to a direction of web travel and generally parallel to said web.

6. The drying compartment as set forth in claim 5, wherein said curved metal sheets are shaped like cylindrical bowls and are positioned opposed to one another in mirror-image fashion on either side of said web.

7. The drying compartment as set forth in claim 6, wherein concave sides of said cylindrical bowl-shape sheets face each other.

8. The drying compartment as set forth in claim 6, wherein said turbulence generator further includes a pair of diagonally inclined metal sheets, arranged in mirror-image fashion on either side of said web, knife-edged inlet edges of said diagonally inclined sheets positioned against a direction of travel of said web, said inlet edges being closer to said web than outlet edges of said sheets.

9. The drying compartment as set forth in claim 1, wherein said drying device includes a convector located nearest said intake opening and an infrared radiator located nearest said outlet opening, said turbulence generator including a first pair of metal sheets positioned in mirror-image fashion on either side of said web between said intake opening and said convector, a second pair of metal sheets positioned in mirror-image fashion on either side of said web between said convector and said radiator, and a third pair of metal sheets positioned in mirror-image fashion on either side of said web between said radiator and said outlet opening.

10. The drying compartment as set forth in claim 9, wherein at least one of said pairs of metal sheets are shaped like cylindrical bowls with concave sides thereof facing one another on either side of said web.

11. The drying compartment as set forth in claim 9, wherein at least one of said pairs comprises diagonally inclined metal sheets having knife-edged inlet edges positioned against a direction of travel of said web, said inlet edges being closer to said web than outlet edges of said sheets.

12. The drying compartment as set forth in claim 10, wherein said second pair comprises diagonally inclined metal sheets having knife-edged inlet edges positioned against a direction of travel of said web, said inlet edges being closer to said web than outlet edges of said sheets.

13. A drying compartment for drying a printed web upon which an insulating layer of air is entrained when said web moves at sufficient speed, said drying compartment comprising:

a housing with intake and outlet openings for the printed web;

a plurality of drying devices located within said housing and in spaced relationship along said web; and a turbulence generator mounted within said housing and including a plurality of pairs of metal sheets, each pair of metal sheets positioned in mirror-image fashion relative to a plane of travel of said web and having a shape which disrupts said insulating air layer to increase an effectiveness of said drying devices.

14. The drying compartment as set forth in claim 13, wherein at least one of said pairs of metal sheets are shaped like cylindrical bowls with concave sides thereof facing one another on either side of said web.

15. The drying compartment as set forth in claim 14, wherein said drying devices include a convector and a radiator, said pairs of metal sheets being positioned on either side of and between said convector and said radiator.

16. The drying compartment as set forth in claim 13, wherein at least one of said pairs comprises diagonally inclined metal sheets having knife-edged inlet edges positioned against a direction of travel of said web, said inlet edges being closer to said web than outlet edges of said diagonally inclined sheets.

17. The drying compartment as set forth in claim 16, wherein said drying devices include a convector and a radiator, said pair of diagonally inclined metal sheets being positioned therebetween.

18. The drying compartment as set forth in claim 17, wherein said turbulence device further includes first and second pairs of metal sheets shaped like cylindrical bowls with concave sides thereof facing one another on either side of said web, said first pair of cylindrical-bowl shape sheets located adjacent said intake opening and said second pair of cylindrical-bowl shape sheets located adjacent said outlet opening.

* * * * *